US010287818B2

(12) United States Patent
Nishida et al.

(10) Patent No.: US 10,287,818 B2
(45) Date of Patent: May 14, 2019

(54) SHADE

(71) Applicant: DAI NIPPON PRINTING CO., LTD., Tokyo (JP)

(72) Inventors: Tomonori Nishida, Tokyo (JP); Norihisa Moriya, Tokyo (JP); Yukio Taniguchi, Tokyo (JP); Satoshi Mitsuzuka, Tokyo (JP); Masayuki Sekido, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 14/783,580

(22) PCT Filed: Apr. 16, 2014

(86) PCT No.: PCT/JP2014/060856
§ 371 (c)(1),
(2) Date: Oct. 9, 2015

(87) PCT Pub. No.: WO2014/171496
PCT Pub. Date: Oct. 23, 2014

(65) Prior Publication Data

US 2016/0060954 A1 Mar. 3, 2016

(30) Foreign Application Priority Data

Apr. 19, 2013 (JP) ..... 2013-088623
May 24, 2013 (JP) ..... 2013-110308

(51) Int. Cl.
*E06B 9/32* (2006.01)
*E06B 9/30* (2006.01)
(Continued)

(52) U.S. Cl.
CPC ..... *E06B 9/30* (2013.01); *E06B 9/307* (2013.01); *E06B 9/32* (2013.01); *E06B 9/386* (2013.01);
(Continued)

(58) Field of Classification Search
CPC ..... E06B 9/386; E06B 2009/2417; E06B 2009/2452; E06B 9/26; E06B 9/30; F21S 11/007; F21V 11/04; F21V 11/02
See application file for complete search history.

(56) References Cited

U.S. PATENT DOCUMENTS 3,438,699 A * 4/1969 Seeger ..... E06B 9/28 359/593
4,773,733 A * 9/1988 Murphy, Jr. ..... E06B 9/386 160/176.1 R
(Continued)

FOREIGN PATENT DOCUMENTS

JP 58-128299 U 8/1983
JP S62-169193 U 10/1987
(Continued)

OTHER PUBLICATIONS

English translation of International Preliminary Report on Patentability (Chapter I) (Application No. PCT/JP2014/060856) dated Oct. 29, 2015.
(Continued)

*Primary Examiner* — Katherine W Mitchell
*Assistant Examiner* — Jeremy C Ramsey
(74) *Attorney, Agent, or Firm* — Burr & Brown, PLLC

(57) ABSTRACT

A shade (10) includes slats (20) that are arranged in an up and down direction. One or more slat(s) (21) forming a part of the slats, which is located above in the up and down direction, includes a transparent portion that enables visible
(Continued)

light to transmit through the slat. A traveling direction of light transmitting through the transparent portion is bent.

11 Claims, 7 Drawing Sheets

(51) Int. Cl.
*E06B 9/386* (2006.01)
*E06B 9/307* (2006.01)
*E06B 9/24* (2006.01)

(52) U.S. Cl.
CPC ..... *E06B 2009/2417* (2013.01); *E06B 2009/2441* (2013.01); *E06B 2009/2452* (2013.01)

(56) References Cited

U.S. PATENT DOCUMENTS

| | | | | |
|---|---|---|---|---|
| 5,461,496 | A * | 10/1995 | Kanada | E06B 9/24 359/592 |
| 6,015,002 | A * | 1/2000 | Biro | B29C 47/065 160/236 |
| 2008/0264581 | A1* | 10/2008 | Lee | E06B 9/386 160/236 |
| 2011/0043919 | A1* | 2/2011 | Ko | E06B 9/24 359/592 |
| 2011/0102879 | A1* | 5/2011 | De Ruijter | E06B 9/386 359/290 |
| 2012/0033302 | A1 | 2/2012 | Suzuki et al. | |
| 2013/0033873 | A1 | 2/2013 | Suzuki et al. | |
| 2014/0016191 | A1* | 1/2014 | Yeh | G02B 5/208 359/361 |
| 2014/0041796 | A1 | 2/2014 | Suzuki et al. | |
| 2014/0293436 | A1* | 10/2014 | Nagahama | G02B 5/045 359/634 |
| 2015/0049387 | A1* | 2/2015 | Kashiwagi | B29C 43/021 359/592 |
| 2015/0226394 | A1* | 8/2015 | Ueki | E06B 9/386 359/595 |
| 2016/0178164 | A1* | 6/2016 | Nishida | E06B 9/303 359/596 |
| 2016/0186948 | A1* | 6/2016 | Gardiner | E06B 9/264 359/595 |
| 2017/0115437 | A1 | 4/2017 | Ito | |

FOREIGN PATENT DOCUMENTS

| | | | |
|---|---|---|---|
| JP | 63-098993 | U | 6/1988 |
| JP | 3018176 | U | 11/1995 |
| JP | 11-036739 | A1 | 2/1999 |
| JP | 2001-032651 | A1 | 2/2001 |
| JP | 2006-028773 | A1 | 2/2006 |
| JP | 2006-222011 | A1 | 8/2006 |
| JP | 2010-259406 | A1 | 11/2010 |
| JP | 2011-186414 | A | 9/2011 |
| JP | 2011-227120 | A1 | 11/2011 |
| JP | 2012-038626 | A1 | 2/2012 |
| JP | 2012-255951 | A1 | 12/2012 |
| WO | 2012/017509 | A1 | 2/2012 |

OTHER PUBLICATIONS

International Search Report (Application No. PCT/JP2014/060856) dated Jul. 8, 2014.
Japanese Office Action (Application No. 2013-110308) dated Apr. 18, 2017 (with English translation).
Japanese Office Action (with English translation), Japanese Application No. 2017-119035, dated Apr. 20, 2018 (6 pages).

* cited by examiner

SHADE

TECHNICAL FIELD

The present invention relates to a shade (in other words "blind") including slats that are arranged in an up and down direction. In particular, the present invention relates to a shade capable of having an excellent daylighting function (in other words "letting-in-light function" or "improving-lighting function").

BACKGROUND ART

As disclosed in JP2006-222011A, shades to be installed on a daylighting window are widely used. Typically, a shade has a number of slats that are vertically arranged at intervals therebetween. Each slat extends horizontally, and is supported such that its inclination can be varied. By adjusting the inclinations of the slats, the shade can offer a privacy function for making the inside of the room not visible from the outside, a light shielding function for an anti-glare effect by preventing outside light coming diagonally from above from directly entering the room, a daylighting function for directly introducing the outside light coming diagonally from above into the room, and so on.

In order for a conventional shade to be able to sufficiently offer the privacy function and the light shielding function, all the slats have to be totally closed, in other words, all the slats have to be raised. In this case, it is impossible to sufficiently let in light inside the room through a window on which the shade is installed. On the other hand, it is hardly necessary, for a window of a regular size, to strictly enforce privacy protection measures against undesirable observation from an upper portion of the window. If some slats facing the upper portion of the window can let in light inside the room such that the outside light coming diagonally from above is thrown upward, it can be avoided that a person in the room directly see the light, while the light shielding function in terms of the anti-glare effect is not impaired. Also, in terms of energy saving, it is highly desirable that a shade can offer the excellent daylighting function, without impairing essentially required functions for the shade such as the privacy function and the light-shielding function.

JP2006-222011A proposes that daylighting means for daylighting for an upper space of the room should be provided above the shade separately from the same. However, such daylighting means is sizable and requires increased manufacturing and installation costs. In the first place, the daylighting means may not be installed on every window, due to the structure around the window.

SUMMARY OF THE INVENTION

The present invention has been made in view of the above circumstances. The object of the present invention is to provide a shade capable of offering the excellent daylighting function that is different from the conventional one.

The shade according to the present invention is a shade comprising slats that are arranged in an up and down direction, wherein one or more slat(s) forming a part of the slats, which is located above in the up and down direction, includes a transparent portion that enables visible light to transmit through the slat, so as to bend a traveling direction of light transmitting through the transparent portion.

In the shade according to the present invention, the one or more slat(s) may include:

transparent first portions that extend in a first direction not in parallel with the up and down direction, and are arranged in a second direction not in parallel with the first direction; and second portions that are arranged alternately with the first portions along the second direction, each second portion having a refractive index different from that of the first portion.

In the shade according to the present invention, at least one of the first portion and the second portion may be colored.

In the shade according to the present invention, the one or more slat(s) may include a unit prism that bends a traveling direction of light by reflection or refraction.

In the shade according to the present invention, an inclination of the one or more slat(s) forming a part of the slats may be operable independently from an inclination of one or more slat(s) forming a different part of the slats.

According to the present invention, the shade can offer the excellent daylighting function.

DETAILED DESCRIPTION OF THE INVENTION

Figure 1:
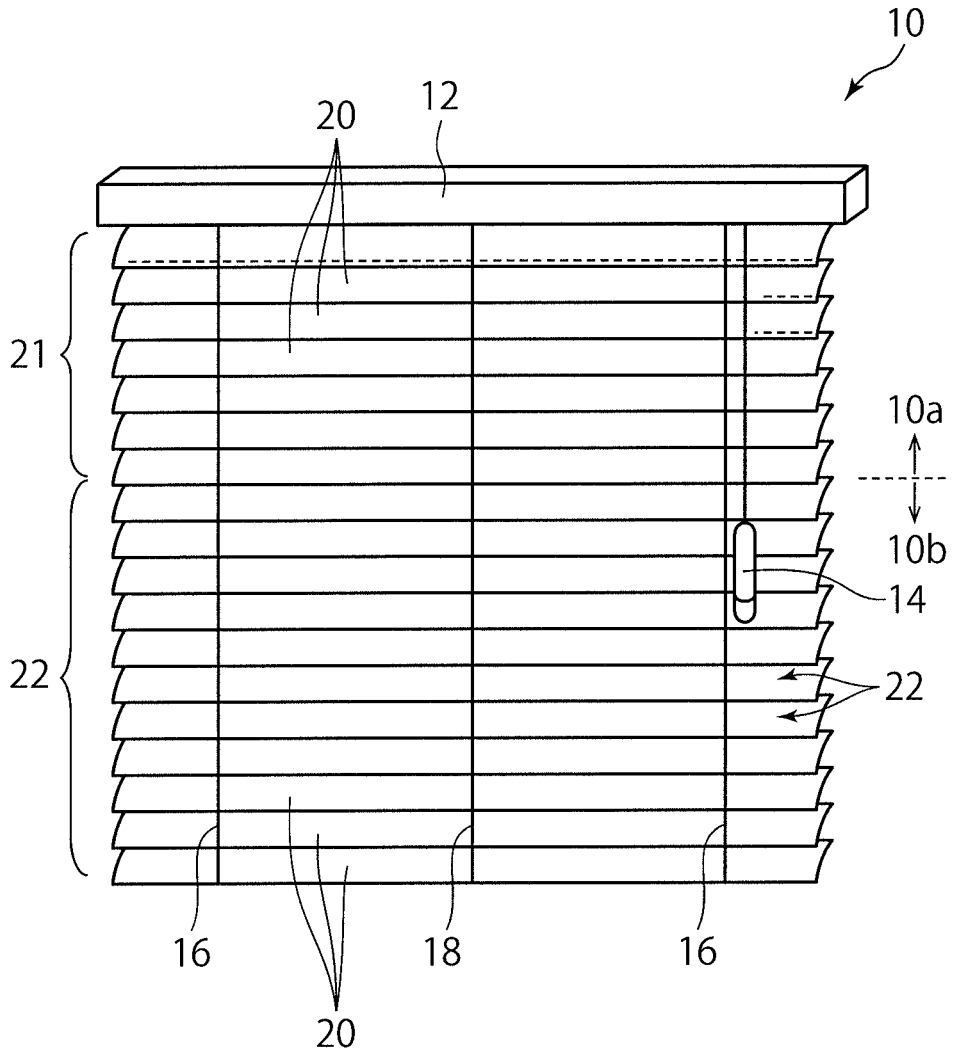
FIG. 1 is a perspective view showing a shade, for explaining an embodiment of the present invention.

An embodiment of the present invention will be described herebelow with reference to the drawings. In the drawings attached to the specification, a scale size, an aspect ratio and so on are changed and exaggerated from the actual ones, for the convenience of easiness in illustration and understanding.

In this specification, terms specifying shapes, geometric conditions and their degrees, e.g., "parallel", "perpendicular", "same", etc., are not limited to their strict definitions, but construed to include a range with a view to obtaining the similar function.

Figure 2:
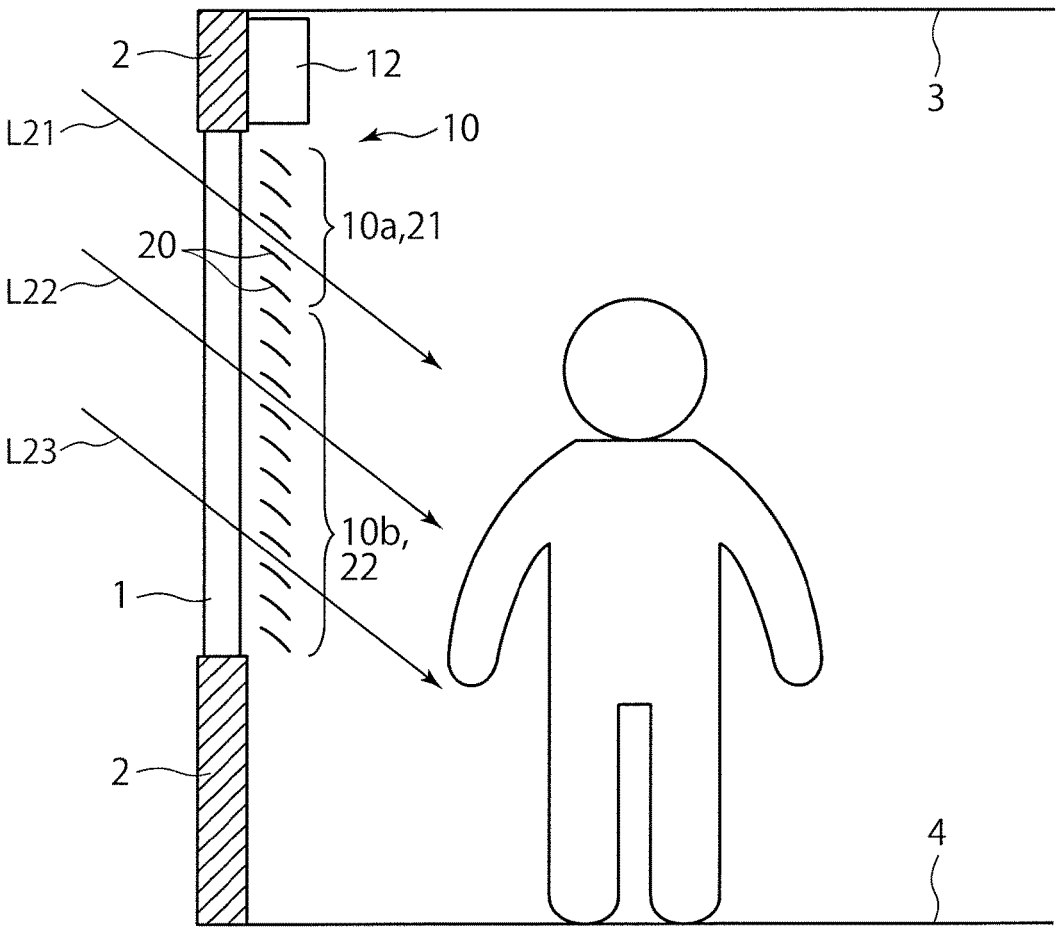
FIG. 2 is a side view schematically showing the shade, with slats of the shade being opened.
Figure 3:
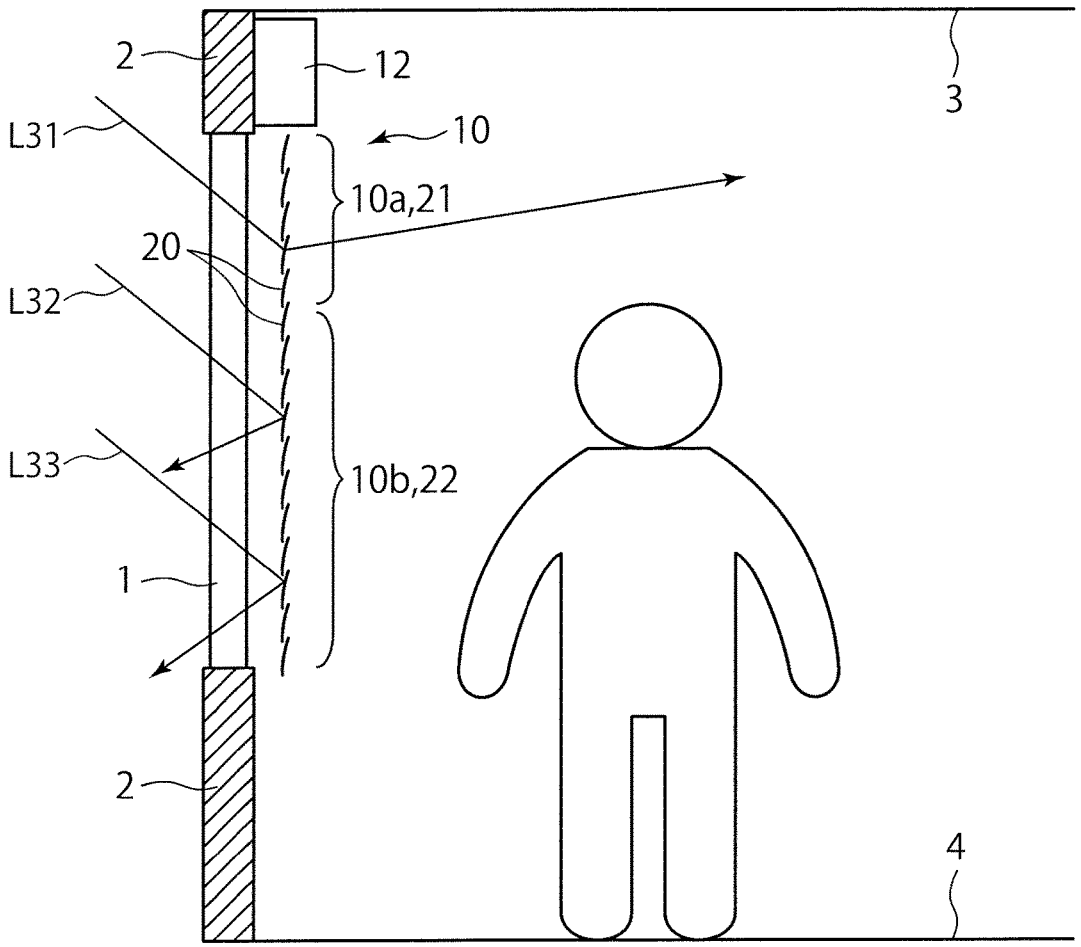
FIG. 3 is a side view schematically showing the shade, with the slats of the shade being closed.
Figure 4:
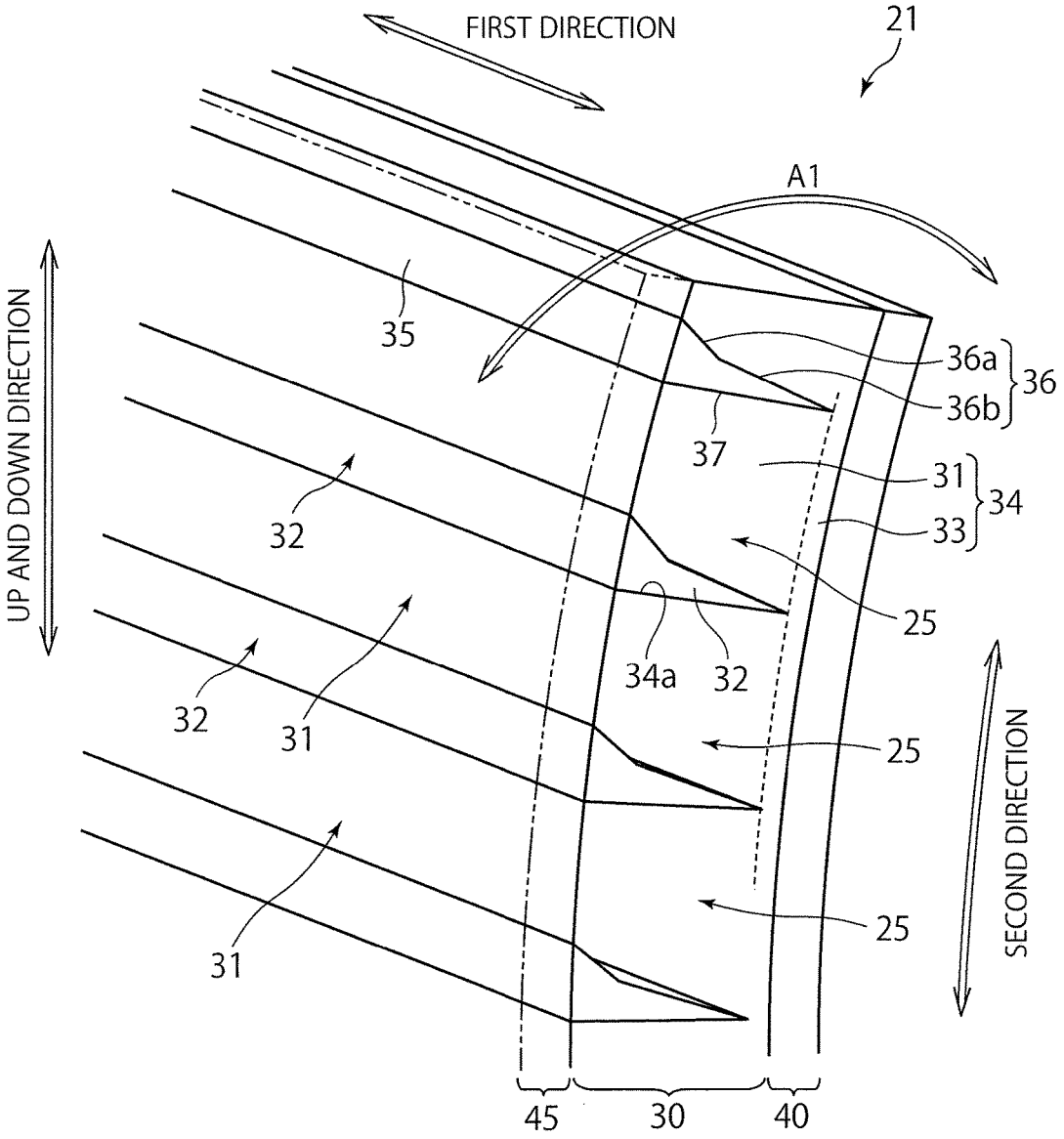
FIG. 4 is a partial perspective view showing a first slat of the shade.
Figure 5:
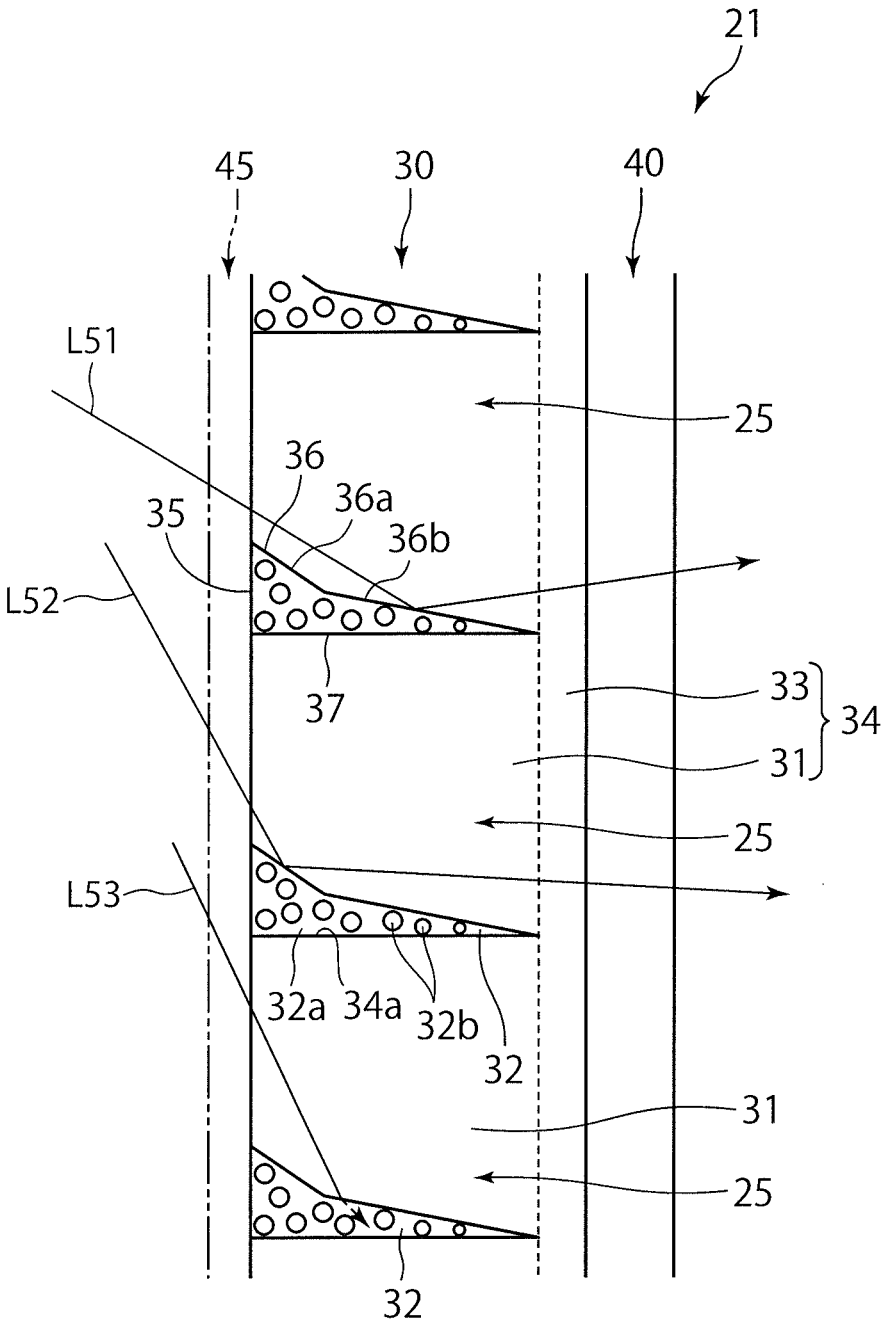
FIG. 5 is a sectional view showing the first slat.

FIGS. 1 to 5 are views for explaining the embodiment of the present invention. FIG. 1 is a perspective view showing a shade. FIGS. 2 and 3 are views showing a movement of slats of the shade and an operation of the shade. FIGS. 4 and 5 are a perspective view and a sectional view showing the slat.

As shown in FIG. 1, a shade 10 includes a number of slats 20 that are arranged in an up and down direction, and means for supporting and operating the slats 20. As shown in FIGS. 2 and 3, the shade 10 is located on a position facing a window 1. The slats 20 are also referred to as louver boards. Each slat 20 is formed as a thin-plate like member which is elongated in a direction not in parallel with the up and down direction. The slat 20 is supported such that its inclination is variable. By adjusting the inclinations of the slats 20, the shade 10 located on the position facing the window 1 can offer various functions as described below.

In this embodiment, the slats 20 included in the shade 10 are vertically arranged, and the respective slats 20 horizontally extend. The shade 10 is disposed in a room that is defined by a wall 2, a ceiling 3 and a floor 4, and is attached to the wall 2 such that the shade 10 faces the lighting window 1 formed in the wall 2. The shade 10 includes: an attachment box 12 serving as an attachment tool to the wall 2; a ladder cord 16 extending downward from the attachment box 12, the ladder cord 16 supporting the slats 20 at vertically intervals; an elevation cord 18 for drawing upward the slats 20; and an operation grip 14 connected to the ladder cord 16 and the elevation cord 18.

In this embodiment, the ladder cord 16 controls the inclination of each slat 20 such that all the slats 20 included in the shade 10 are substantially parallel. By operating the ladder cord 16 through the operation grip 14, the inclination of the slat 20 can be adjusted. On the other hand, by operating the elevation cord 18 through the operation grip 14, the slats 20 can be drawn upward in such a manner that the vertical intervals between the slats 20 are sequentially narrowed from below. At this time, the slats 20 are at least partially accommodated in the attachment box 12, so that the window 1 is exposed to the room. Similarly, by operating the elevation cord 18 through the operation grip 14, the slats 20 gathered in the upper position can be drawn downward to the position facing the window 1. In the shade 10 in this embodiment, various known structures can be used as the attachment box 12, the operation grip 14, the ladder cord 16, the elevation cord 18, and the mechanism for operating the ladder cord 16 and the elevation cord 18 through the operation grip 14.

Next, the slat 20 is described in more detail. In this embodiment, as shown in FIGS. 2 and 3, the slat 20 is formed like a slightly curved thin plate. The slats 20 may be configured to have the same outer profile with one another. Meanwhile, in the shade 10 herein, one or more slat(s) 21, which is located above in the up and down direction, is configured to be capable of offering a function that is different from that of another slat 22. Particularly in this embodiment, the slats 20 included in the shade 10 are divided into a first slat 21 which is located in an upper area 10*a* that is upper in the up and down direction, and a second slat 22 which is located in a lower area 10*b* that is lower in the up and down direction. The first slat 21 and the second slat 22 are different from each other in structure.

The second slat 22 among the slats 20 included in the shade 10 can be configured similarly to the conventional slat. Thus, a thin plate member made of an anticorrosive aluminum alloy, a thin plate made of a wooden material or a thin plate made of a resin may be used as the second slat 22, for example. Such second slat 22 is opaque and has a visible-light shielding property. In particular, the second slat 22 has a function for reflecting visible light to vary a traveling direction of incident light. A surface of the second slat 22 is provided with a functional layer for imparting to the shade 10 a heat shielding function, an antifouling function, an antibacterial function, and a deodorant function. For example, a fluorine coating and/or a titanium oxide coating may be provided to the second slat 22.

Next, the first slat 21 among the slats 20 included in the shade 10 is explained with reference mainly to FIGS. 4 and 5. The first slat 21 has a transparent portion 25 that enables the visible light to transmit therethrough. The first slat 21 is configured to bend a traveling direction of light transmitting through the transparent portion 25.

As described above, the slats 20 including the first slat 21 and the second slat 22 have a curved thing-plate like profile. However, FIG. 5 illustrates the first slat 21 having a flat thin-plate like profile, in order to facilitate understanding of the overall optical function of the first flat 21. In addition, the first slat 21 shown in FIGS. 4 and 5 is raised, like the slats 20 shown in FIG. 3.

As shown in FIGS. 4 and 5, the first slat 21 includes a substrate layer 40, and a light control layer 30 supported on the substrate layer 40. The substrate layer 40 and the light control layer 30 extend along a plate surface of the first slat 21. On the other hand, the transparent portion 25 that changes a traveling direction of light intersects the first slat 21 in a direction normal to the plate surface of the first slat 21. Thus, the transparent portion 25 enables light to transmit through the first slat 21 in a thickness direction thereof. In this point, the first slat 21 drastically differs from the conventional slat having the light shielding property in the thickness direction. In this embodiment, the transparent portion 25 of the first slat 21 is formed by at least a part of the substrate layer 40 and the light control layer 30. More specifically, the transparent portion 25 is formed at least by a portion including a below-described first portion 31 included in the light control layer 30, which extends in a direction normal to the plate surface of the first slat 21. Herebelow, the substrate layer 40 and the light control layer 30 are sequentially explained.

In this embodiment, the substrate layer 40 is provided because of a below-described manufacturing method of the light control layer 30, but is not a particularly essential constituent element. The substrate layer 40 may be formed of a transparent or semitransparent resin film, for example. On the other hand, in order that the substrate layer 40 can positively offer some function, the substrate layer 40 may be provided with an antifouling function, an antibacterial function, a deodorant function, etc. Similarly, as shown by the two-dot chain lines in FIGS. 4 and 5, a functional layer 45, which is expected to offer some function, such as an antifouling function, an antibacterial function, a deodorant function, a protective function, may be further provided on a side of the light control layer 30 opposed to the substrate layer 40.

Next, the light control layer 30 of the first slat 21 is explained. The light control layer 30 includes a number of first portions 31 that extend in a first direction d1 not in parallel with the up and down direction and are arranged in a second direction d2, and a number of second portions 32 that are arranged alternately with the first portions 31 along the second direction d2. In the illustrated example, the first portions 31 and the second portions 32 are alternately arranged adjacently to one another. The light control layer 30 further includes a sheet-like base portion (land part) 33 supporting the first portions 31 and the second portions 32. The base portion 33 is formed integrally with the first portions 31, so as to form a light control layer body 34 together with the first portions 31. In other words, the light control layer 30 includes the light control layer body 34 having grooves 34 formed therein, and the second portions 32 respectively formed in the grooves 34 of the light control layer body 34. A portion between the adjacent grooves 34*a* of the light control layer body 34 defines the first portion 31.

As shown in FIG. 4, in this embodiment, the first portions 31 and the second portions 32 horizontally extend in parallel with a longitudinal direction of the first slat 21. Namely, the first direction d1, which is the longitudinal direction of the first portions 31 and the second portions 32, horizontally extends. The first portions 31 and the second portions 32 are alternately arranged in the second direction d2 that is perpendicular to the first direction d1 and is in parallel with the plate surface of the thin-plate like first slat 21. The plate surface of the slat 20 means a surface that conforms to a plane direction of the target plate-like slat 20 when it is comprehensively observed as a whole. Thus, in this embodiment, the plate surface of the slat 20 is a curved surface.

As shown in FIG. 4, each slat 20 has a curved shape about a horizontally extending axis line. As shown by the arrow A1 in FIG. 4, by means of the ladder cord 16, each slat 20 is rotated about a horizontally extending axis line, so that an inclination of the plate surface of the slat 20 can be varied.

Next, the shapes of the first portion 31 and the second portion 32 are explained. FIG. 5 shows the first slat 21 along a main section of the first slat 21, i.e., a section that is in parallel with both the second direction d2 along which the first portions 31 and the second portions 32 are arranged, and the direction normal to the plate surface of the first slat 21. As shown in FIG. 5, the second portion 32 includes a bottom surface 35 forming a part of the surface of the light control layer 30 opposed to the side of the substrate layer 40, a first side surface 36 extending from the bottom surface 35, and a second side surface 37 extending from the bottom surface 35. In the illustrated example, the first side surface 36 and the second side surface 37 come close to each other, away from the bottom surface 35 along the direction normal to the plate surface of the first slat 21. Finally, the first side surface 36 and the second surface 37 connect to each other. In the illustrated example, the second side surface 37 is formed as a flat surface, while the first side surface 36 is formed as a folded surface. In particular, in the illustrated example, the first side surface 36 includes a steeply inclined surface 36*a* connected to the bottom surface 35, and a mildly inclined surface 36*b* located on a side away from the bottom surface 35 to be connected to the second side surface 37. An angle of the steeply inclined surface 36*a* relative to the direction normal to the plate surface of the first slat 21 is larger than an angle of the mildly inclined surface 36*b* relative to the direction normal to the plate surface of the first slat 21.

In the illustrated example, the second portions 32 are arranged at equal intervals along the second direction d2. In addition, in the illustrated example, the second portions 32 included in the one first slat 21 have the same structure with one another. Due to the aforementioned structure of the second portions 32, in the illustrated example, the first portions 31 included in the one slat 21 are arranged at equal intervals along the second direction d2, and have the same structure with one another.

An arrangement pitch of the second portions 32 along the second direction d2 at the section shown in FIG. 5 may be 1 mm or smaller, for example. A height of the second portion 32 along the direction normal to the plate surface of the first slat 21 may be 1 mm or smaller. In addition, a thickness of the light control layer 30 along the direction normal to the plate surface of the first slat 21 may be not less than 100 μm and not more than 2 mm.

However, the illustrated structures of the first portion 31 and the second portion 32 are mere examples, and can be suitably changed, e.g., in consideration of the daylighting function of the first slat 21 described below. For example, the sectional shape of the second portion 32 can be changed variously, e.g., to a triangular shape, a trapezoidal shape, etc. In addition, the first slats 21 may have the same structure with one another, or the first slats 21 may differ from one another in shape and/or arrangement of at least one of the first portion 31 and the second portion 32.

Next, materials of the first portion 31 and the second portion 32 are explained. The first slat 21 includes the transparent portion 25 that enables light to transmit in the thickness direction. Thus, at least one of the first portion 31 and the second portion 32, which are arranged along the plate surface of the first slat 21, is transparent. In this specification, the term "transparent" means that a visible light transmittance is 50% or more. The visible light transmittance in this specification is determined as follows. A 1-μm thick film of a material forming a part to be measured is deposited on a PET film manufactured by TOYOBO Co., Ltd. (product number: Cosmo Shine A4300, thickness: 100 μm). Then, by using a spectrophotometer (manufactured by Shimadzu Corporation, "UV-2450", compliant with JISK0115), transmittances of the part are measured with measurement wavelength range of from 380 nm to 780 nm. An average value of the transmittances at the respective wavelengths is the visible light transmittance.

In this embodiment, the first portion 31 is transparent. The visible light transmittance of the first portion 31 is preferably 70% or more. More preferably, the visible light transmittance of the first portion 31 is 90% or more. Namely, in this embodiment, the transparent portion 25 that varies a traveling direction of light is formed by the first portion 31, and portions of the base portion 33 and the substrate layer 40, which are juxtaposed with the first portion 31 along the direction normal to the first slat 21. As a material for use in the light control layer body 34 forming the first portion 31 and the base portion 33 integrally formed with the first portion 31, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance. A concrete example of the resin material may be an acrylic resin.

On the other hand, the second portion 32 has a refractive index different from that of the first portion 31. In this embodiment, the second portion 32 includes a main portion 32*a* functioning as a binder, and an optional functional content 32*b* dispersed in the main portion 32*a*. The refractive index of the main portion 32*a* is different from the refractive index of the first portion 31. As a result, an interface between first portion 31 and the second portion 32 has an refractive index difference so as to function as a surface that reflects visible light. In order that the visible light incident from the side of the first portion 31 is reflected on the interface between the first portion 31 and the second portion 32, the refractive index of the second portion 32 is preferably adjusted to be smaller than the refractive index of the first portion 31. As a material for use in the main portion 32*a* of the second portion 32, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance. A concrete example of the resin material may be an acrylic resin having a refractive index different from that of the acrylic resin for use in the first portion 31. However, in a case where the second portion 32 includes the functional content 32*b*, the same acrylic resin as that of the first portion 31 may be used, if the refractive index of the second portion 32 is changed by the functional content 32*b*.

The functional content 32*b* of the second portion 32 is dispersed in the main portion 32*a* with a view to various functions. For example, the functional content 32*b* may be a heat absorbing agent or a coloring agent. As the heat absorbing agent, there are used particles having an absorption property for light in a near-infrared light wavelength range, and a transmission property for light in a visible light wavelength range. Specifically, as the heat absorbing agent, inorganic nanoparticles having transparency may be used. For example, there may be used antimony tin oxide (ATO), indium tin oxide (ITO), lanthanum hexaboride ($LaB_6$), aluminum-doped zinc oxide, indium-doped zinc oxide, gallium-doped zinc oxide, tungsten oxide, cerium hexaboride, anhydrous antimony tin oxide, and copper sulfide, or mixture of these nanoparticles.

As the coloring agent, there may be used particles having a function of absorbing at least light of a certain wavelength range within the visible light wavelength band. As an example of the coloring agent, there may be used a pigment, more specifically, a black pigment such as carbon black, graphite, titanium nitride, etc., or a white pigment such as titanium oxide, etc. In addition, bluish particles such as iron blue, blue or violet particles, reddish particles and yellowish particles may be used as the coloring agent. Due to the functional content 32*b* as the cooling agent included in the second portion 32, the second portion 32 can be colored. At this time, a design property can be given to the shade 10, in consideration of the color quality of the second start 22 and so on.

The light control layer 30 as structured above may be manufactured in the following manner. The light control layer body 34 forming the first portions 31 and the base portions 33 is manufactured by using a curing material such as epoxy acrylate, which will cure by irradiation of an ionizing radiation such as an electron radiation or an ultraviolet radiation. To be specific, a mold roll having projections corresponding to the structure (position, shape or the like) of the grooves 34*a* of the light control layer body 34, in other words, a mold roll having recesses corresponding to the structure (position, shape or the like) of the first portions 31, is prepared. A sheet for forming the substrate layer 40 is fed between the mold roll and a nip roll. In accordance with the feeding of the sheet, the curing material is supplied between the mold roll and the substrate layer 40. Thereafter, the curing material is pressed by the mold roll and the nip roll, such that the recesses of the mold roll are filled with the uncured, liquid curing material supplied to the substrate layer 40. At this time, the curing material is supplied to the substrate layer 40 such that the curing material is thicker than a depth of each recess of the mold roll, i.e., the mold roll and the substrate layer 40 are not brought into contact with each other, so that the above-described base portion (land part) 33 is formed integrally with the first portions 31 out of the curing material. After the space between the substrate layer 40 and the mold roll is filled with the uncured, liquid curing material, light is irradiated to the curing material to cure (solidify) the curing material, whereby the light control layer body 34 can be formed.

Then, the second portions 32 are manufactured by using an uncured liquid composition which includes a curing material which cures to form the main portion 32*a*, and the optional functional content 32*b*. As the curing material which cures to form the main portion 32*a*, there may be used a curing material such as urethane acrylate which cures by an ionizing radiation. Firstly, the composition is supplied to the light control layer body 34 that has been already formed. Thereafter, while the composition is filled into the grooves 34*a* formed between the adjacent first portions 31, i.e., into the portions corresponding to the projections of the mold roll, the superfluous composition overflowing from the grooves 34*a* is scraped by means of a doctor blade. After that, an ionizing radiation is irradiated to the composition between the first portions 31 to cure the composition, so that the second portions 32 are formed. Thus, there is manufactured the first slat 21 including the substrate layer 40, the base portion 33 disposed on the substrate layer 40, and the first portions 31 and the second portions 32 disposed on the base portion 33.

Next, an operation of the shade 10 in the aforementioned embodiment is explained. Firstly, the inclinations of the slats 20, which are arranged at intervals in the up and down direction at a location facing the window 1, is adjusted by operating the operation grip 14. In this embodiment, the thin-plate like slats 20 are arranged such that their plate surfaces are parallel to one another. By operating the operation grip 14, the inclinations of all the slats 20 included in the shade 10 can be adjusted.

The operation of the shade 10 under the condition shown in FIG. 2 is explained. Under the condition shown in FIG. 2, the plate surface of each slat 20 is inclined to both the horizontal direction and the vertical direction so as to be gradually lowered from the outside to the inside of the room. In particular, the inclination of the slat 20 is adjusted such that the plate surface of the slat 20 is substantially in parallel with an incident direction of sunlight beams. According to such a shade 10, since sunlight beams L21, L22 and L23 can be efficiently introduced into the room, the room can be brightly illuminated by the sunlight beams L21, L22 and L23. Simultaneously, since the second slat 22 located in the lower area 10*b* is opaque, visibility of the inside of the room from the outside can be obstructed by the second slat 22. Namely, the second slat 22 can daylight the room, while making the room not visible from the outside.

The first slat 21 located in the upper area 10*a* is at least partially transparent. However, an upper edge of the window 1 is generally positioned at a position above a human visual line or a human body height. Thus, the fact that the room is visible through the upper portion of the window 1 rarely causes problems, although it depends on an environment around the widow 1. Thus, it is unconceivable that the privacy function of the shade 10 is seriously deteriorated by the fact that the first slat 21 includes the transparent portion.

However, from this point of view, the upper area 10*a* on which the first slat 21 is located is preferably positioned above a general human body height or above a visual line of a person in the room. For example, the upper area 10*a* is preferably positioned above 180 cm. In addition, when at least one of the first portion 31 and the second portion 32 of the first slat 21 is colored, e.g., when the functional content 32*b* in the second second portion 32 is a coloring agent, the room can be effectively made not visible from the outside also by the first slat 21. Thus, the shade 10 can sufficiently offer a privacy protection function, while sunlight can be introduced in to the room.

Next, the operation of the shade 10 under the condition shown in FIG. 3 is explained. Under the condition shown in FIG. 3, the plate surface of each slat 20 extends substantially vertically. According to such a shade 10, the opaque second slat 22 located in the lower area 10*b* offers the privacy function, whereby room can be made not visible highly effectively. Thus, for example, the privacy can be protected. In addition, it can be prevented that sunlight beams L32 and L33 directly enter the room without changing traveling directions thereof. Namely, in terms of the anti-glare effect, the shade 10 can offer the light shielding function for restricting the light from directly reaching the room. In addition, the shade 10 with the sluts 20 being closed can offer the heat shielding function by restricting movement of heat between the room and the outside.

When the conventional shade is under the totally closed condition shown in FIG. 3, the conventional shade restricts the sunlight from entering the room. Thus, the room becomes dark and a room light is needed. On the other hand, according to this embodiment, the upper first slat 21 of the sluts 20 included in the shade 10 includes the light control layer 30 having the first portion 31 and the second portion 32 which constitute the refractive index interface. Under the totally closed condition shown in FIG. 3, the second direction d2 along which the first portion 31 and the second portion 32 are arranged extends substantially vertically as shown in FIG. 5. In addition, in this embodiment, the side of the bottom surface 35 of the second portion 32 is positioned on the outside, and the first side surface 36 is positioned above. Thus, as shown in FIG. 5, sunlight beams L51 and L52 coming diagonally from above to enter the first slat 21 are reflected on the interface between first portion 31 and the first side surface 36 of the second portion 32. Thus, as shown in FIG. 3, the sunlight beam L31 coming diagonally from above is thrown up toward an upper zone of the room, typically, a zone above the first slat 21 on which the sunlight beam entered. Therefore, the sunlight beam L31 incident on the first slat 21 can be introduced to the inside area of the room distant from the window 1.

In particular, when the refractive index of the second portion 32 is lower than the refractive index of the first portion 31, light that was incident on the first portion 31 to reach the interface between the first portion 31 and the second portion 32 can be totally reflected. The total reflection is preferred in that it does not generate any reflection loss, whereby the sunlight can be introduced in a desired direction at high efficiency, and temperature increase in the first slat 21 can be avoided.

Moreover, in this embodiment, as shown in FIG. 5, the first side surface 36 of the second portion 32 has the steeply inclined surface 36*a* on the outside which serves as the light incident side, and the mildly inclined surface 36*b* on the inside. Thus, as shown in FIG. 5, the light beam 52 that travels in a direction relatively largely inclined to the horizontal direction is likely to enter the steeply inclined surface 36*a*. The steeply inclined surface 36*a* can bend the traveling direction of the light beam L52 coming from the steeply inclined direction, such that the light beam L52 is not so upright, so as to effectively guide the light beam L52 to the inside area of the room distant from the window 1 in the room. On the other hand, the light beam L51 that travels in a directly relatively mildly inclined to the horizontal direction is likely to enter the mildly inclined surface 36*b*. The mildly inclined surface 36*a* can bend the traveling direction of the light beam L51 coming from the mildly inclined direction, such that the light beam L51 is not so upright, so as to effectively guide the light beam L51 to the inside area of the room distant from the window 1 in the room.

As described above, although the first slat 21 located in the upper area 10*a* is at least partially transparent, the fact that the room is visible through the upper portion of the window 1 rarely causes problems. Thus, in general, the transparent portion of the first slat 21 does not seriously deteriorate the privacy function of the shade 10. In addition, the first slat 21 introduces the sunlight beam L31 so as to be thrown upward. Thus, it can be effectively prevented that a person in the room feels that the light let in by the first slat 21 is too bright. Further, since the daylighting of sunlight beams in winter conforms to the essential heat shielding object for storing heat by avoiding release of heat from the room to the outside, the heat shielding function should be promoted from the viewpoint of energy saving. As to the summer, when the first slat 21 contains a heat absorbing agent, specifically, when the second portion 32 contains the heat absorbing agent as the functional content 32*b*, the movement of heat from the outside to the room can be effectively prevented. Thus, there is no possibility that the heat shielding function of the shade 10 is impaired. In addition, by adjusting the position and the size of the upper area 10*a*, the heat shielding function of the shade 10 is not seriously impaired. Namely, under the totally closed condition of the slats 20 shown in FIG. 3, the first slat 21 of the slats 20 can realize daylighting of the room with sunlight, without impairing the privacy function, the light shielding function and the heat shielding function of the shade 10.

When at least one of the first portion 31 and the second portion 32 of the first slat 21 is colored, the shade 10 can further offer various favorable functions. For example, when the second portion 32 includes the functional content 32*b* as the coloring agent, the second portion 32 can absorb at least light of a certain wavelength range within the visible light wavelength band. According to this example, as shown in FIG. 5, a light beam L53, which has enters the second portion 32 without being reflected on the interface between the first portion 31 and the second portion 32, can be absorbed by the second portion 32. Thus, the first slat 21 can positively offer not only the daylighting function, but also the privacy function and the light shielding function.

Further, as a condition different from the conditions shown in FIGS. 2 and 3, when it is desirable to positively introduce light into the room from the outside, the second slat 22 located in the lower area 10*b* of the shade 10 may be drawn upward from the condition shown in FIG. 3. Under this condition, the lower portion of the window 1 is exposed without being covered with the shade 10, so that it is possible to let in light inside the room without any limitation by the shade 10. On the other hand, by adjusting the inclination of the first slat 21 located in the upper area 10*a* such that its plate surface extends vertically similarly to FIG. 3, the sunlight beam L31 can be thrown up. As a result, light can be introduced to entire area of the room.

According to the above embodiment, the one or more slat(s) 21 located above includes the transparent portion 25 that enables visible light to transmit therethrough, so as to bend a traveling direction of light transmitting the transparent portion. To be more specific, the one or more slat(s) 21 located above includes the first portions 31 and the second portions 32 that are arranged in stripes. The first portion 31 forms the transparent portion 25, and the second portion 32 has the refractive index different from that of the first portion 31. Thus, the shade 10 can offer the excellent daylighting function, without impairing other functions required for the shade 10. For example, the shade 10 can sufficiently offer the privacy function and the light shielding function.

In addition, in the aforementioned embodiment, at least one of the first portion 31 and the second portion 32 may be colored. In this case, the shade 10 can offer other functions such as the privacy function and the light shielding function, in addition to the excellent daylighting function. In addition, when at least one of the first portion 31 and the second portion 32 of the first slat 21 is colored by the same color as that of the second slat 22, the shade 10 has a chic design and can fit in the room on which the shade 10 is installed. Further, when at least one of the first portion 31 and the second portion 32 of the first slat 21 is positively colored, the shade 10 can serve as an ornament of the room on which it is installed.

The aforementioned embodiment can be variously modified. Herebelow, an example of modification is explained with reference to the drawings. In the drawings referred to in the below description, a part corresponding to that of the above embodiment is indicated by the same symbol and detailed description thereof is omitted.

For example, in the above embodiment, although the slat 20 has the curved shape, the present invention is not limited thereto. The slat may have a flat thin-plate like shape.

In addition, in the above embodiment, although the area in which the first slat 21 is located and the area in which the second slat 22 is located are divided in the up and down direction, the present invention is not limited thereto. For example, as long as the aforementioned first slat 21 realizes the daylighting function, the one or more slats 20 located above may constitute the first slat 21. Thus, for example, in the aforementioned upper area 10*a*, there may be the second slat 22 in addition to the first slat 21. In this case, the excellent daylighting function can be offered by the first slat 21 located in the upper area 10*a*. Simultaneously therewith, even in the upper area 10*a*, the essential functions of the shade 10, such as the privacy function, the light shielding function, the heat shielding function, etc., can be provided by the second slat 22.

Further, in the above embodiment, in order that at least one of the first portion 31 and the second portion 32 of the first slat 21 is colored, the second portion 32 contains the functional content 32*b* as a coloring agent. However, the present invention is not limited thereto. In place of the fact that the second portion 32 contains the coloring agent or in addition to the fact that the second portion 32 contains the coloring agent, the first portion 31 may contain the coloring agent, and/or at least one of the first portion 31 and the second portion 32 may be colored by providing a colored layer on a surface of at least one of the first portion 31 and the second portion 32.

Figure 6:
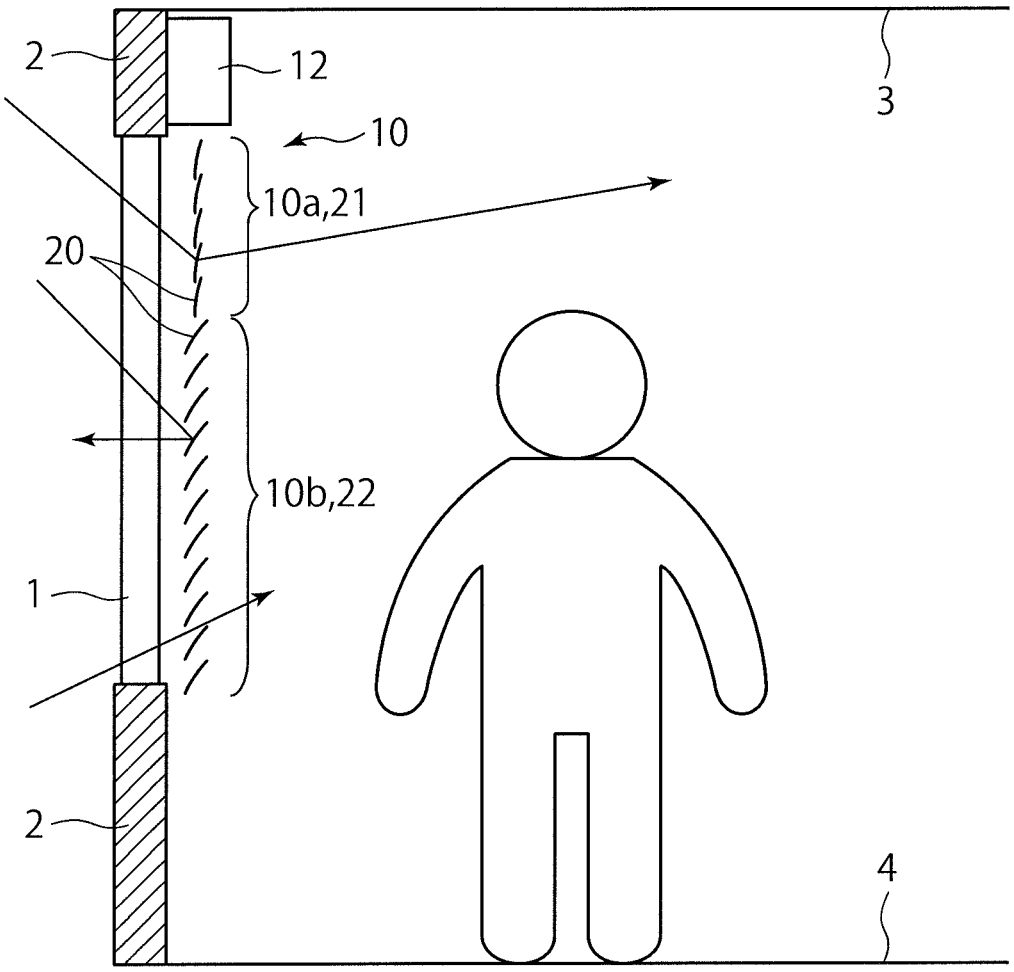
FIG. 6 is a side view for explaining a modification example of the shade.

Furthermore, in the above embodiment, all the slats 20 included in the shade 10 are operated at the same time by the ladder cord 16, such that the inclinations of the slats 20 are parallel with one another. However, as shown in FIG. 6, for example, the slats 20 located in the upper area 10*a* and the slats 20 located in the lower area 10*b* may be operated by separated ladder cords, so that the inclinations of the slats 20 in the upper area 10*a* and the inclinations of the slats 20 in the lower area 10*b* can be adjusted separately from each other. In the example shown in FIG. 6, the first slat 21 located in the upper area 10*a*, and the second slat 22 is located in the lower area 10*b*. In the example shown in FIG. 6, the first slat 21 effectively offers the aforementioned daylighting function, with its plate surface extending vertically. On the other hand, the inclination of the second slat 22 is adjusted separately from the inclination of the first slat 21, such that the second slat 22 can offer the privacy function, the light shielding function, the heat shielding function to a desired degree, depending on the position of the sun, the condition peculiar to the room on which the shade 10 is installed (e.g., outside environment) and so on.

Figure 7:
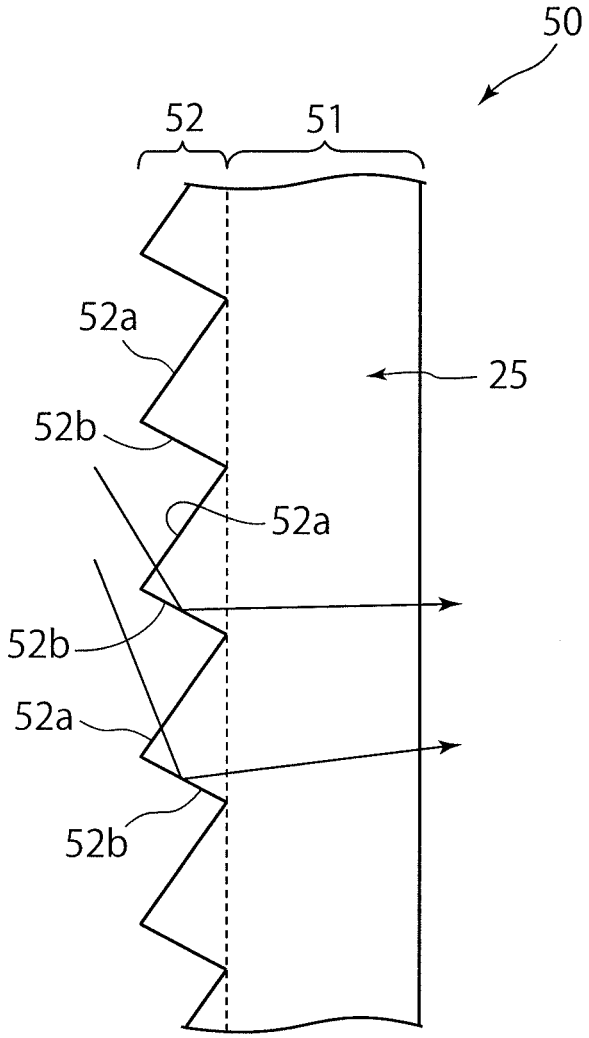
FIG. 7 is a view corresponding to FIG. 5, showing a modification example of the first slat.

Yet furthermore, in the above embodiment, the first portion 31 of the first slat 21 forms the transparent portion 25 so as to bend a traveling direction of light traveling in the transparent portion 25 by reflecting the light on the interface between the first portion 31 and the second portion 32, whereby the daylighting function for introducing the sunlight beams L31, L51 and L52 in a desired direction can be obtained. However, the present invention is not limited thereto. As shown in FIG. 7, the first slat 21 may have a prism surface 50. Light is introduced into the room by bending a traveling direction of light by reflection or refraction on the prism surface 50. In the example shown in FIG. 7, the first slat 21 has a sheet-like body part 51 and a number of unit prisms 52 arranged on the body part 51. The body part 51 and the unit prisms 52 are transparent to enable light to transmit therethrough. In addition, in the example shown in FIG. 7, the unit prisms 52 are arranged in the second direction d2 perpendicular to the longitudinal direction of the first slat 21, and extend in the first direction d1 in parallel with the longitudinal direction of the first slat 21. Further, the unit prisms 52 are arranged without any space therebetween on one surface of the body part 51.

Each unit prism 52 has a first surface 52*a* and a second surface 52*b* arranged opposedly to the second direction d2. In the first slat 21, light incident on the unit prism 52 through one of the first surface 52*a* and the second surface 52*b* is reflected, in particular, totally reflected on the other of the first surface 52*a* and the second surface 52*b* of the unit prism. Thus, a traveling direction of the sunlight is varied, so that the sunlight can transmit through the first slat 21. Namely, in the example shown in FIG. 7, the overall first slat 21 forms the transparent portion 25 that enables the light to pass therethrough and varies a traveling direction of light. When the inclination of the first slat 21 is varied about an axis line in parallel with the first direction d1 by means of the ladder cord 16 or the like, the direction of the sunlight incident on the first slat 21 can be varied.

The "unit prism" in this specification means an element having a function for exercising an optical action, such as refraction and reflection, on light so as to vary a traveling direction of the light. The unit prism will not be differentiated from elements such as "unit shaped element", "unit optical element" and "unit lens", based only on the difference in name. Similarly, "prism", "lens" and "optical element" will not be differentiated from one another, based only on the difference in name. The shape of the unit prism 52 used in the first slat 21 is not limited to the shape shown in FIG. 7, and unit prisms of various structures may be used.

Although some modification examples of the above embodiment have been described, it goes without saying that these modification examples may be suitably combined to one another.

The invention claimed is:

1. A shade comprising a plurality of slats that are arranged in an up and down direction, wherein at least one first slat of the plurality of slats, which is located in an upper portion of the shade, includes transparent first portions extending in a first direction that is in nonparallel with respect to an up-and-down direction, second portions arranged alternately with the first portions in a second direction that is in nonparallel with respect to the first direction, and a base portion supporting the first portions and the second portions, wherein the base portion is integrally formed with the first portions, wherein the first portions enable visible light to transmit through the at least one first slat, and the at least one first slat bends upward a traveling direction of the light transmitting through the transparent first portions, wherein each second portion includes a resin material and a heat absorbing agent dispersed in the resin material, wherein the second portions have a different refractive index from that of the first portions, wherein the at least one first slat has a curved shape, and the second direction extends along a curved plate surface of the at least one first slat, and wherein a width along the second direction of the second portions decreases away from a convex surface side of the curved slat toward a concave surface side of the curved slat.

2. The shade according to claim 1, wherein at least one of the first portions or at least one of the second portions are colored.

3. The shade according to claim 1, wherein the at least one first slat includes a unit prism that bends a traveling direction of the light by reflection or refraction.

4. The shade according to claim 1, wherein an inclination of the at least one first slat located in the upper portion of the shade is operable independently from an inclination of at least one second slat located in a different portion of the shade.

5. The shade according to claim 2, wherein an inclination of the at least one first slat located in the upper portion of the shade is operable independently from an inclination of at least one second slat located in a different portion of the shade.

6. The shade according to claim 3, wherein an inclination of the at least one first slat located in the upper portion of the shade is operable independently from an inclination of at least one second slat located in a different portion of the shade.

7. The shade according to claim 4, wherein the different portion of the shade is a lower portion of the shade.

8. The shade according to claim 1, wherein the at least one first slat includes a substrate layer, and a light control layer supported on the substrate layer, wherein the substrate layer and the light control layer extend along a plate surface of the at least one first slat.

9. The shade according to claim 8, wherein the transparent portion that enables visible light to transmit through the at least one first slat, and bends a traveling direction of the visible light transmitting through the transparent portion, enables the visible light to transmit through the at least one first slat in a thickness direction thereof.

10. The shade according to claim 1, wherein at least one second slat of the plurality of slats, which is located in another portion of the shade spaced away from the at least one first slat, includes an opaque portion that shields light from passing through the at least one second slat.

11. The shade according to claim 1, wherein at least one of the second portions includes a substantially planar bottom surface with opposing first and second ends, a first side surface projecting at a first acute angle from the first end, the first acute angle having a first slope, and a second side surface projecting at a second acute angle from the second end, wherein the second side surface has a second slope that is different from the first slope, and wherein the first side surface and the second side surface meet to define an obtuse angle.

* * * * *